US009357866B2

(12) United States Patent
Allahverdian

(10) Patent No.: US 9,357,866 B2
(45) Date of Patent: Jun. 7, 2016

(54) CLIP FOR HANGING A NECKTIE

(71) Applicant: Edward Allahverdian, Glendale, CA (US)

(72) Inventor: Edward Allahverdian, Glendale, CA (US)

( * ) Notice: Subject to any disclaimer, the term of this patent is extended or adjusted under 35 U.S.C. 154(b) by 0 days.

(21) Appl. No.: 14/189,361

(22) Filed: Feb. 25, 2014

(65) Prior Publication Data

US 2015/0076094 A1 Mar. 19, 2015

(51) Int. Cl.

| | |
|---|---|
| ***A47F 7/00*** | (2006.01) |
| ***A47F 5/08*** | (2006.01) |
| ***A47G 29/00*** | (2006.01) |
| ***A47G 25/74*** | (2006.01) |
| ***A47G 25/48*** | (2006.01) |
| ***A47G 25/28*** | (2006.01) |
| ***A47F 7/12*** | (2006.01) |
| ***A47G 25/32*** | (2006.01) |

(52) U.S. Cl.

CPC ..... *A47G 25/743* (2013.01); *A47F 7/12* (2013.01); *A47G 25/28* (2013.01); *A47G 25/32* (2013.01); *A47G 25/482* (2013.01); *A47G 25/485* (2013.01); *A47G 25/746* (2013.01); *Y10T 24/44906* (2015.01)

(58) Field of Classification Search

CPC ... A47G 25/743; A47G 25/746; A47G 25/48; A47G 25/481; A47G 25/482; A47G 25/483; A47G 2025/484; A47G 25/485; A47G 25/486; A47G 25/0607; A47G 25/0657; A47G 25/74; A47G 25/005; A47G 25/02; A47G 25/06; A47G 25/0614; A47G 25/0621; A47G 25/0685; A47G 25/14; A47G 25/24; A47G 25/26; A47G 25/28; A47G 25/32; A47G 25/34; A47G 25/487; A47G 25/488; A47G 25/50; A47G 25/52; A47B 61/003; A47B 61/02; A47B 61/04; A47F 7/10; A47F 7/12; A47F 7/18; A47F 7/19; A47F 7/22; A47F 7/24; A47F 5/08; A47F 7/08; A47F 7/00; B65D 85/18; D06F 55/02; D06F 55/00; F16B 2/22; F16B 2/20; F16B 2/245; Y10T 24/344; Y10T 24/3443; Y10T 24/44274; Y10T 24/44906

USPC ..... 211/85.3, 119, 105.1, 89.01, 124; 223/85, 90, 91, 95, 96, DIG. 1, DIG. 2; 24/561

See application file for complete search history.

(56) References Cited

U.S. PATENT DOCUMENTS

| | | | | | |
|---|---|---|---|---|---|
| 1,991,987 | A | * | 2/1935 | Smith | 223/91 |
| 2,378,578 | A | * | 6/1945 | Oskow | 223/90 |
| 2,403,834 | A | | 7/1946 | Streit | |
| 2,440,024 | A | | 4/1948 | Schwiering | |
| 2,546,717 | A | * | 3/1951 | Beetlestone et al. | 223/96 |
| 2,633,995 | A | | 4/1953 | Edelheit | |
| 2,885,758 | A | * | 5/1959 | Russo et al. | 24/531 |
| 2,985,311 | A | * | 5/1961 | Abel | 211/85.3 |
| 3,018,026 | A | * | 1/1962 | Binkley | A47G 25/485 223/91 |
| 3,203,061 | A | * | 8/1965 | Thomas | 24/338 |
| 3,268,128 | A | * | 8/1966 | Hobi | 223/96 |
| 3,456,262 | A | * | 7/1969 | Coon | 24/501 |

(Continued)

*Primary Examiner* — Jennifer E Novosad

(74) *Attorney, Agent, or Firm* — The Law Office of Scot S. Fagerland

(57) ABSTRACT

A closet hanger especially for neckties. The hanger features a novel plastic clip, which allows easy one-handed insertion and removal of ties. Each clip supports the tie with lateral elastic tension. A plurality of clips is arranged to allow ties to be hung face-to-face, saving space over hangers that support ties side-by-side. An adjustable hook screw secures the hanger fixedly in place on the rod.

3 Claims, 5 Drawing Sheets

(56) References Cited

U.S. PATENT DOCUMENTS

| | | | | | |
|---|---|---|---|---|---|
| 3,856,190 | A | | 12/1974 | Mole et al. | |
| 3,967,766 | A | | 7/1976 | Hart | |
| 4,121,798 | A | * | 10/1978 | Schumacher et al. | 248/113 |
| 4,221,298 | A | * | 9/1980 | Wright et al. | 211/4 |
| 4,312,464 | A | * | 1/1982 | Treiman | 223/85 |
| 4,335,838 | A | * | 6/1982 | Bisk et al. | 223/91 |
| 4,368,823 | A | | 1/1983 | Beckwith | |
| 4,669,642 | A | * | 6/1987 | Nicholas | 223/94 |
| 4,763,390 | A | * | 8/1988 | Rooz | 24/487 |
| 4,807,334 | A | * | 2/1989 | Blanchard | 24/487 |
| 5,075,935 | A | * | 12/1991 | Abdi | 24/511 |
| D324,785 | S | | 3/1992 | Kleinke | |
| 5,159,730 | A | * | 11/1992 | Radvin | 24/543 |
| 5,294,005 | A | * | 3/1994 | Hedges | 211/85.7 |
| 5,402,558 | A | * | 4/1995 | Santapa | 24/511 |
| 5,463,189 | A | * | 10/1995 | Deneke et al. | 174/138 G |
| 5,526,968 | A | | 6/1996 | Larson | |
| 5,775,554 | A | | 7/1998 | Taylor | |
| 5,836,486 | A | * | 11/1998 | Ohsugi | 223/85 |
| 6,974,057 | B1 | | 12/2005 | Smith | |
| 7,201,297 | B1 | * | 4/2007 | Baziuk | 223/85 |
| 7,611,034 | B1 | * | 11/2009 | Peterson | 223/88 |
| 8,534,513 | B1 | * | 9/2013 | Dixon | 223/91 |
| 8,893,936 | B2 | * | 11/2014 | Kuroda | 223/91 |
| 2003/0126725 | A1 | * | 7/2003 | Housley | 24/510 |
| 2009/0283556 | A1 | * | 11/2009 | Ho | 223/85 |
| 2010/0122961 | A1 | * | 5/2010 | Moreau | 211/85.7 |
| 2014/0027597 | A1 | * | 1/2014 | Farris | 248/339 |

* cited by examiner

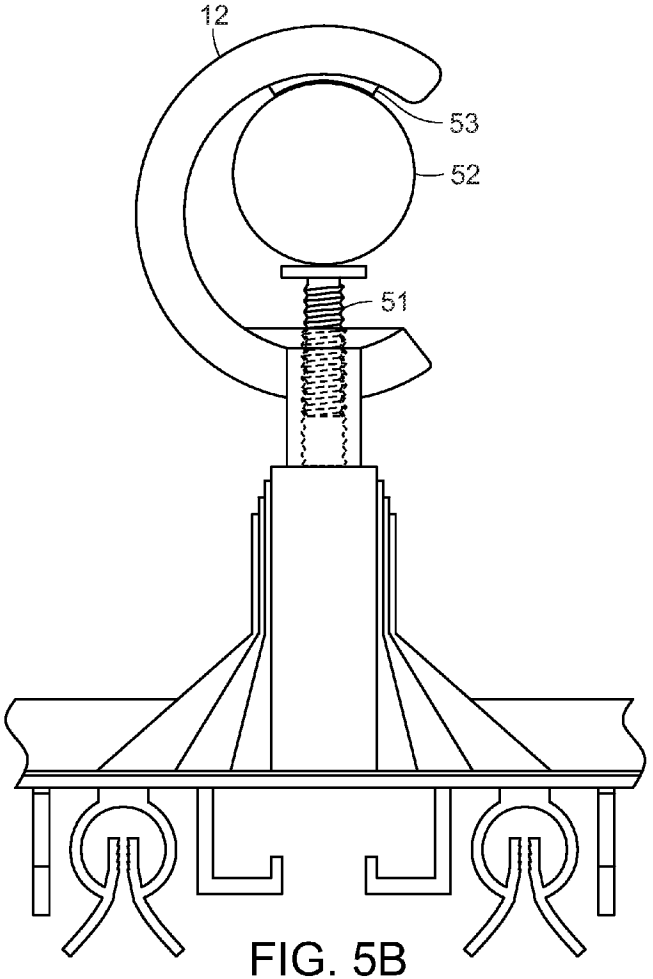
FIG. 5B
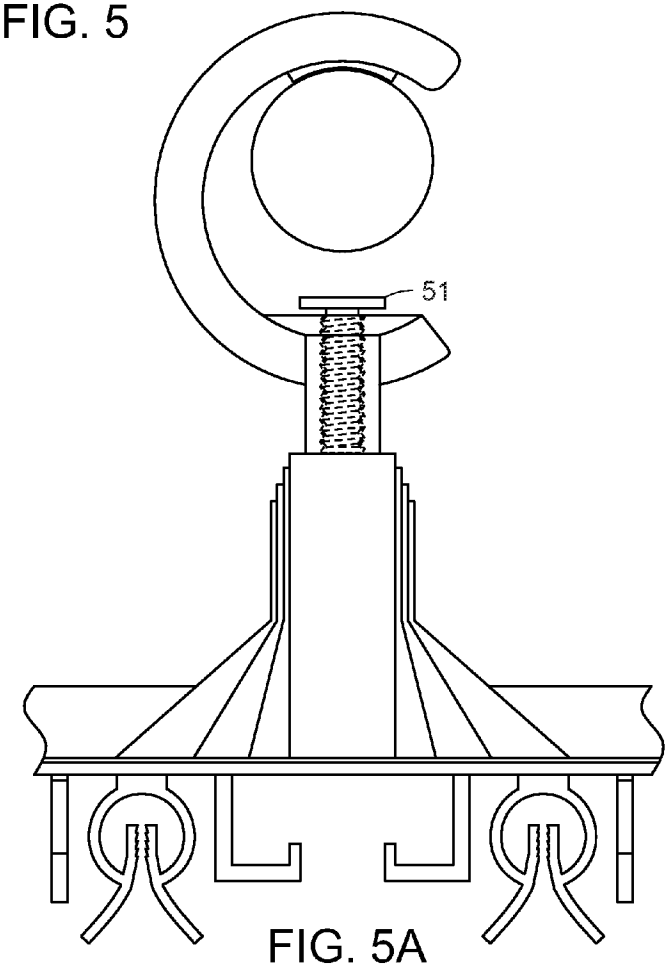
FIG. 5A
FIG. 5

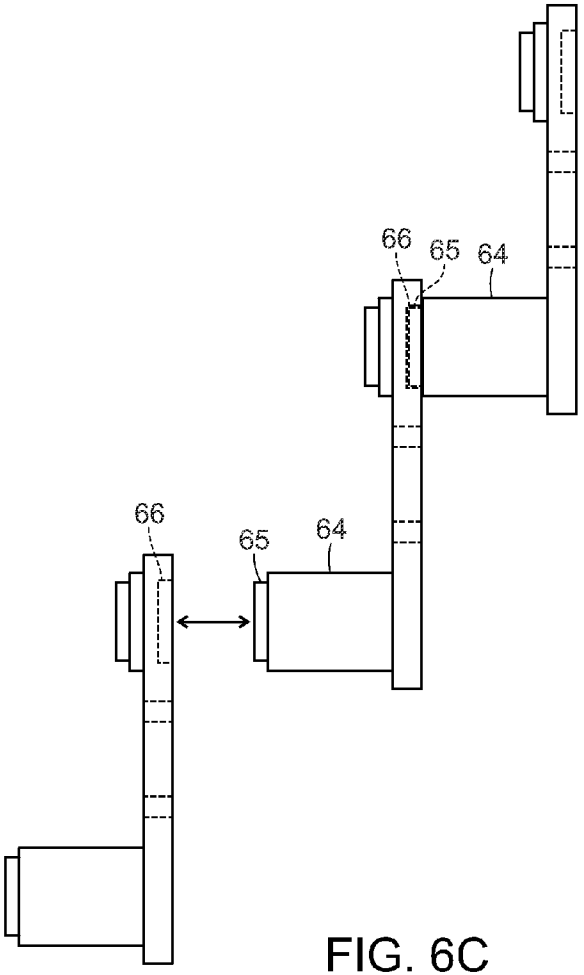
FIG. 6C
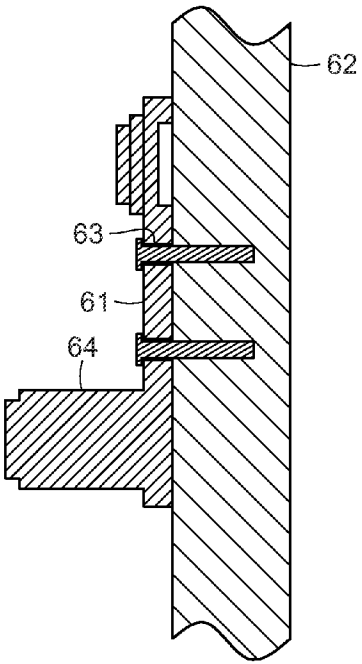
FIG. 6B
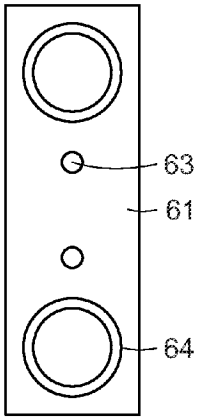
FIG. 6A
FIG. 6

CLIP FOR HANGING A NECKTIE

1. FIELD OF THE INVENTION

OK to [1] This invention is in the field of closet hangers, particularly hangers for men's neckties and accessories.

2. BACKGROUND AND OBJECTS OF THE INVENTION

Neckties can be an awkward accessory in the closet. Due to its length, a necktie tends to slip easily off of conventional hangers and hooks. The balancing act usually requires the use of both hands. In the process of hanging or removing one tie, other nearby ties can easily be knocked loose onto the floor. Belts present similar challenges.

A man may have a great number of neckties in a small closet. The best storage solution is one that economizes space.

What is needed is a hanger for neckties and belts that economizes closet space, holds accessories securely, and is easy to use with one hand. Those objects are all achieved by this invention.

3. DISTINCTION FROM RELATED TECHNOLOGY

Several hangers exist for the purpose of hanging neckties. Some are simply racks, providing horizontal bars over which to drape ties. It is particularly difficult to keep neckties draped over racks.

Other solutions use clamps or clips to help secure the tie. Examples are disclosed in U.S. Pat. No. 4,368,823 (Beckwith), U.S. Pat. No. 3,967,766 (Hart), U.S. Pat. No. 2,440,024 (Schwiering), U.S. Pat. No. 6,974,057 (Smith), and U.S. Pat. No. 2,403,834 (Streit).

Beckwith discloses a hanger where ties are secured by "clamps which press the ties against the crossarm over which they are draped. The clamps in Beckwith's invention are operated by a pull rod. The rod is lifted to release the clamps. The rod is lowered to secure the ties against the crossbar. With such a design, the Beckwith hanger requires two hands to use. When the rod is lifted, the ties are not secured, leaving them prone to falling. As a space-saving consideration, because the ties are folded over the crossarm, the number of ties that can be accommodated by the hanger is limited to the width of the hanger divided by the width of the ties.

The limitations of Hart's hanger are similar to Beckwith's. Hart uses an elastomeric band to clamp ties to the bottom bar of the hanger. Again, two hands are required to put ties back onto the hanger. Again, the ties' are arranged side-to-side so that their width limits the hanger's capacity.

Schwiering's tie rack likewise arranges ties side-to-side. One of the objects of this invention, dating from the pre-plastic World War II era, was to provide a rack made entirely of wood, "circumventing conditions under which metal is either unavailable or too expensive to use."

Smith discloses a hanger that again arranges ties side-to-side in the direction of the hanger's width. Smith's hanger employs clips. "The clips each have a pair of arms biased toward each other." Each clip has to be opened with one hand to remove or insert a tie with the other hand.

My invention offers an advantage over the prior art for purposes of economizing space. By situating the ties face-to-face, perpendicular to the hanger bar, my hanger accommodates a great number of ties.

My invention offers an advantage over the prior art for purposes of being easy to use with one hand. Each clip in my hanger consists of plastic "pinchers" that support the tie with lateral elastic tension. The pinchers do not need to be open and closed. A tie can be inserted with a vertical motion of one hand, and removed with a horizontal motion of the same hand.

My hanger also offers the advantage of being secured against the closet rod so that the hanger does not tip or swivel. Hangers supporting accessories can become very imbalanced. Imagine, for instance, a hanger with a belt on one end. I solve this problem with a screw in the hook, which can be adjusted so that it fits snugly against the closet rod. This screw mechanism will be described in further detail below.

Treiman (U.S. Pat. No. 4,312,464) discloses a "latchable" hanger. Treiman writes, "This invention comprises a latchable swivel hook garment hanger in which the swiveling hook may be latched in any radial position relative to the hanger body and unlatched to swivel, repeatedly at will." Treiman's latch does not engage with the closet rod. In his hanger, the "swiveling" is along the vertical axis, i.e. rotation of the hanger in a plane parallel to the floor. My hanger screw prevents my hanger from rotating around the closet-rod axis as well.

4. SUMMARY OF THE INVENTION

The first primary feature of my hanger is the specially fabricated tie clip. The clips are made of molded plastic. Each clip has two prongs. The prongs are further apart at the lower opening, and closer together at the top end. A necktie that is folded in half is inserted into the clip, at the fold, with a single upward motion of one hand. The prongs of the clip secure the tie laterally, by virtue of the prongs' elasticity. The prongs are also serrated. The serration causes the prongs to be directionally biased, so that it is easy to slide fabric upward into the prongs, but very difficult to pull fabric out downward. The tie is then removed from the prongs by pulling the tie with one hand toward the user and slightly upward. At no time does use of the hanger require two hands. At no time does inserting or removing one tie cause other ties to fall.

The clips descend from the underside of the hanger. Their orientation positions the ties face-to-face. Therefore, the number of ties is not limited by the ties' width.

The second primary feature of my hanger is the stability system. Stability is provided at the junction between the hanger hook and the closet rod. An adjustable hook screw is mounted in the stem of the hook. After the hanger is hung, the screw can be twisted upward until it abuts the bottom of the rod. The stability system is completed by providing friction at the top of the rod. This can be accomplished with rough material, teeth, a brace, or other similar means on the hanger hook.

A secondary and optional feature of this hanger is a mount system, allowing the hanger to be mounted to a vertical surface such as a wall or door. A mount screws into the vertical surface and provides a very short rod protruding horizontally a few inches. The mounts are designed to fit each other so that they may be stacked two or three high.

5. BRIEF DESCRIPTION OF THE DRAWINGS

Figure 4:
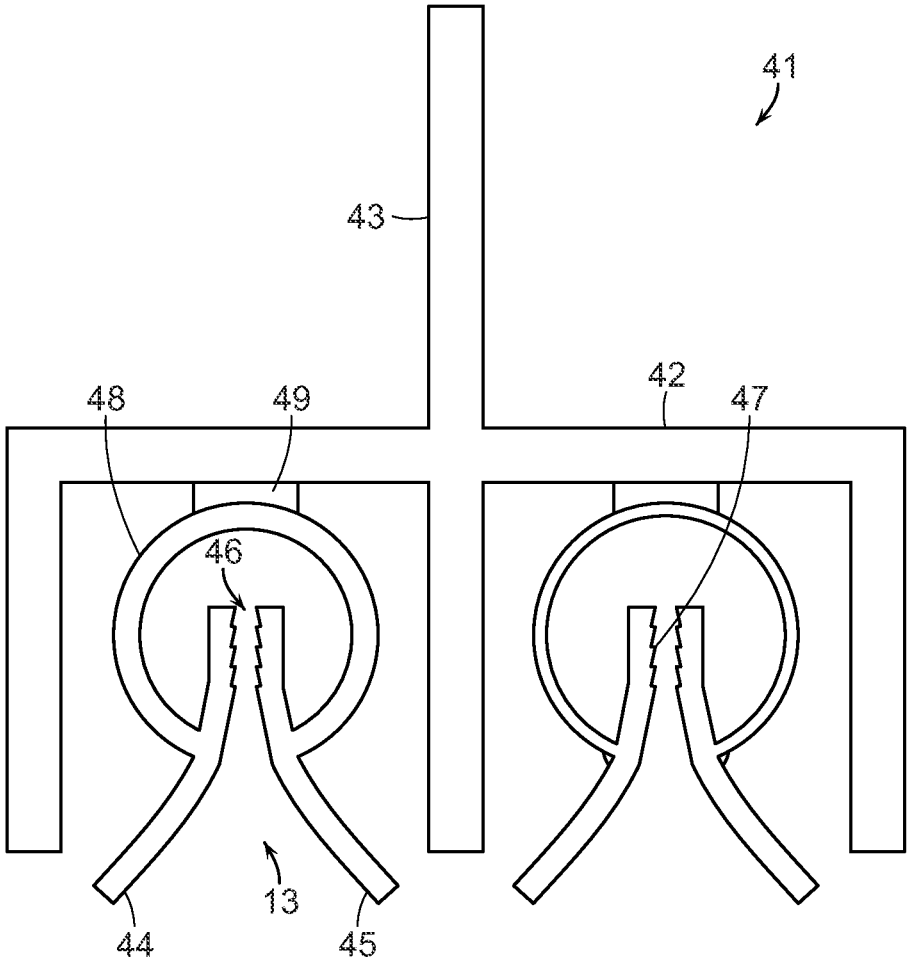

FIG. 4 is a front-plan view of a clip unit. The figure shows a rectangular frame and circular clip loops. A physical embodiment of the invention is not restricted to these particular shapes.

FIG. 5 is a front-plan view of the hanger hook. Hidden lines show the adjustable hook screw mounted inside the hook stem. The screw is in the down/open position in FIG. 5A, and the up/locked position in FIG. 5B.

FIG. 6 shows the mount system. FIG. 6A is a front-plan view of one mount unit.

FIG. 6B is a side-plan view of one mount unit mounted to a vertical surface. FIG. 6C is a side-plan view of three mount units mounted together.

6. DETAILED DESCRIPTION OF THE PREFERRED EMBODIMENTS

Figure 1:
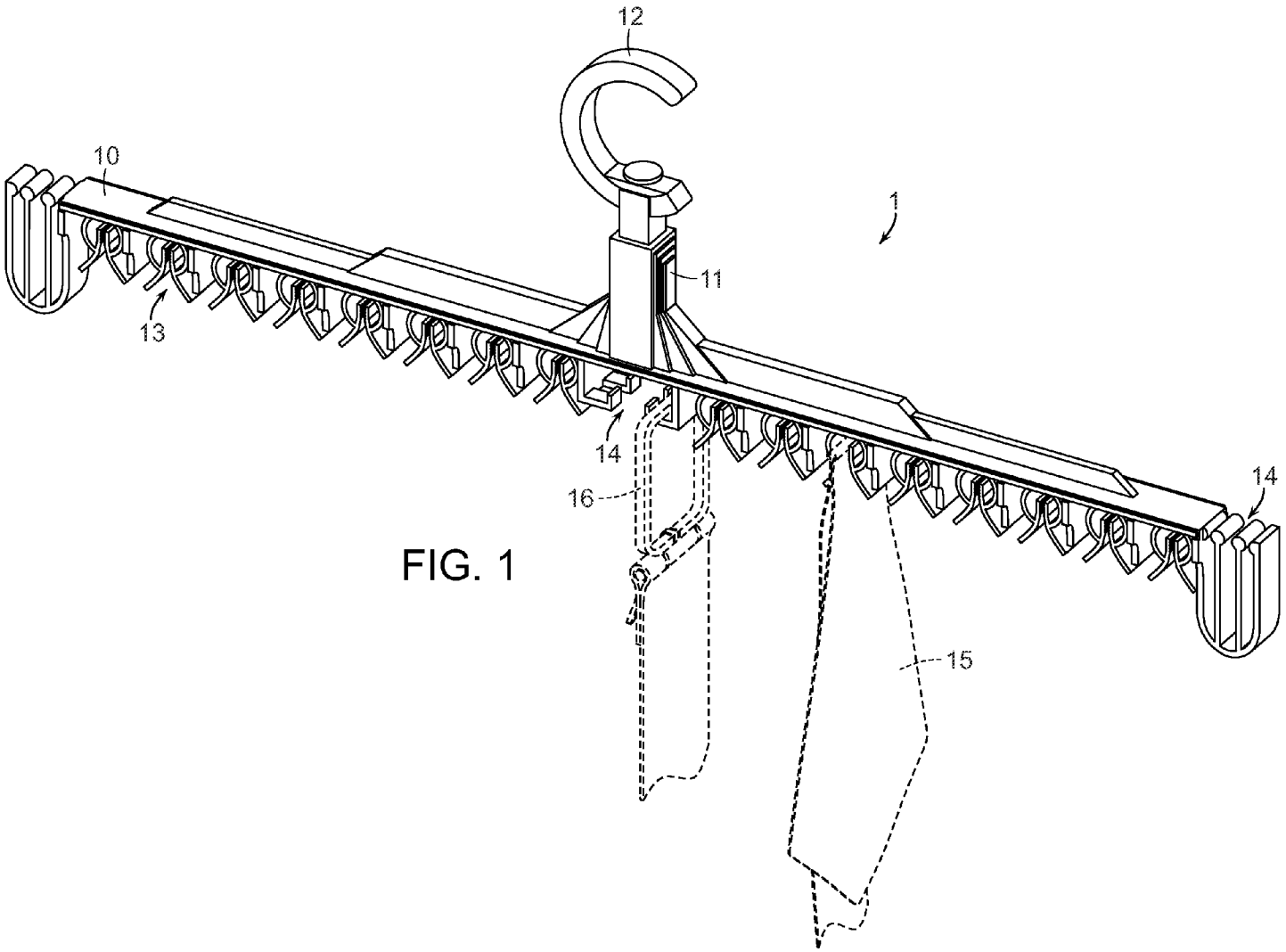
FIG. 1 is a perspective view of the hanger supporting a tie and a belt.
Figure 2:
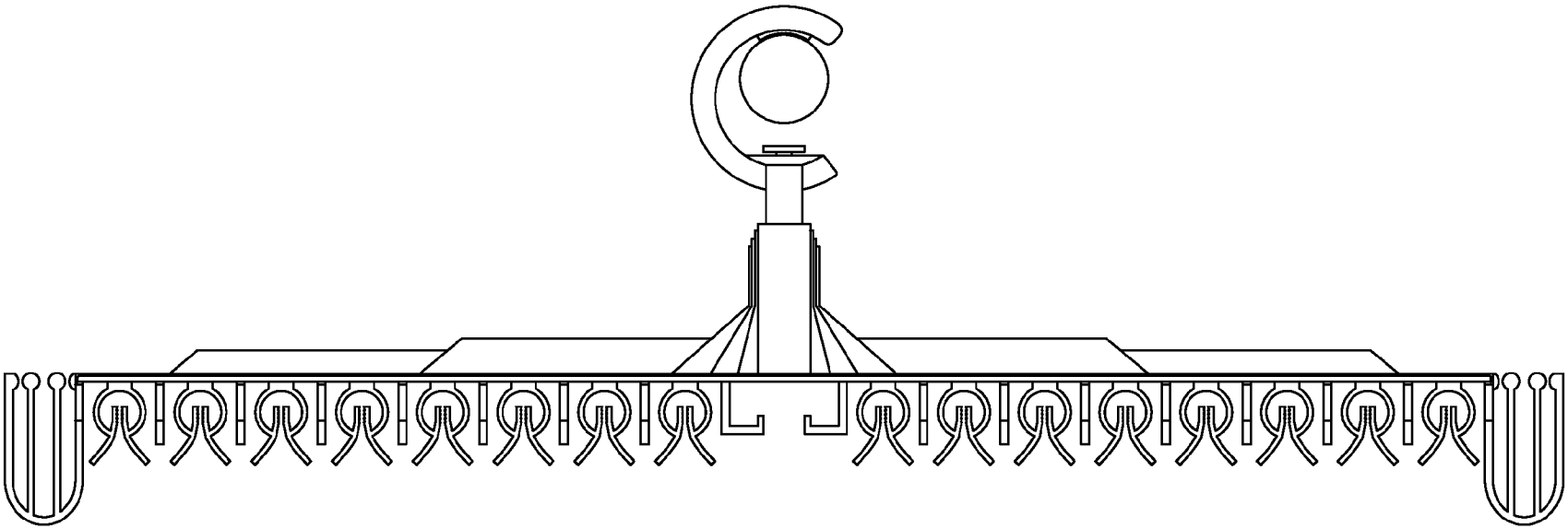
FIG. 2 is a front-plan view of the hanger supported on a rod.
Figure 3:
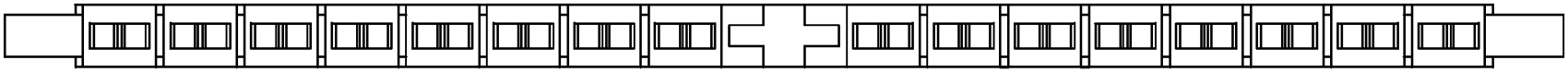
FIG. 3 is a bottom-plan view of the hanger.

FIG. 1 shows the primary features of the invention. The hanger 1 comprises a bar 10, a hook stem 11, and a hook 12. Descending from the bar are a series of tie clips 13. The tie clips are a major point of novelty in this invention and will be described in further detail below. The bar 10 may additionally support any number of traditional hooks 14 for belts, bowties, pocket squares, hats, jewelry, or other accessories. In this figure, a tie 15 and belt 16 are shown supported by the hanger 1.

FIG. 4 shows a close-up of the tie clips 13. The tie clips 13 are constructed in pairs. Each pair shall be referred to as a tie-clip unit 41. The tie-clip unit 41 provides a frame 42 for physical support, and a stem 43 for insertion into the underside of the hanger bar 10. Each clip 13 comprises a left prong 44 and a right prong 45. The permanent gap between the prongs is wider at the lower end and narrower at the upper end. At its narrow end, the permanent gap 46 between the prongs is slightly less than the thickness of a folded necktie 15. Therefore, when a necktie 15 is inserted into the permanent gap 46, the tie will exert a lateral force on the left prong 44 and right prong 45. The prongs will in turn react with opposite lateral forces, securing the tie 15 in place with friction. A serration 47 on each prong helps hold the tie in place. The serration is biased to easily allow the tie to be inserted upward, but not to allow the tie to slip downward once in place.

The left prong 44 and right prong 45 are secured to a clip loop 48, which is mounted to the frame 42 by tab 49. The clip loop 48 holds the prongs in place and provides additional elasticity for the lateral force that holds the tie in place.

FIG. 5 shows the hanger's stability system. Inside the hook stem 11 is an adjustable hook screw 51. In FIG. 5A, the hook screw 51 is in a downward or open position. In FIG. 5B, the hook screw 51 is in an upward or locked position. In the locked position, the hook screw 51 is pressed firmly against the underside of the closet rod 52. This locks the hanger 1 in place on the closet rod 52, so that the hanger 1 does not tip or sway even when loaded unevenly with weight.

The hanger hook 12 is constructed with a grip 53 for simultaneously providing stability on the upper half of the closet rod 52. Grip 53 may be a rough material such as sandpaper, small teeth, or any brace that contacts the closet rod 52 in a no-slip manner.

I claim:

1. A clip for hanging neckties, essentially consisting of:

a frame, a clip loop attached to said frame, a left prong attached to said clip loop, and a right prong attached to said clip loop;

a permanent gap between said left prong and said right prong, extending the full length from between the lower end of the left prong and the lower end of the right prong to between the upper end of the left prong and the upper end of the right prong;

said permanent gap being wider between the lower end of the left prong and the lower end of the right prong than between the upper end of the left prong and the upper end of the right prong;

wherein said clip loop, said left prong, and said right prong are constructed of an elastic solid;

at least one serration on the upper end of the left prong;

at least one serration on the upper end of the right prong;

wherein the permanent gap is adapted to receive a necktie inserted vertically between the lower end of the left prong and the lower end of the right prong;

and wherein the permanent gap is adapted to pinch the tie between the at least one serration on the upper end of the left prong and the at least one serration on the upper end of the right prong.

2. A hanger for hanging neckties, comprising:

a horizontal hanger bar;

a vertical hook stem protruding upward from said hanger bar;

a hook connected to the top of said hook stem;

a plurality of tie clips protruding downward from the underside of said hanger bar;

each tie clip consisting essentially of a frame, a clip loop attached to said frame, a left prong attached to said clip loop, and a right prong attached to said clip loop;

a permanent gap between said left prong and said right prong, extending the full length from between the lower end of the left prong and the lower end of the right prong to between the upper end of the left prong and the upper end of the right prong;

said permanent gap being wider between the lower end of the left prong and the lower end of the right prong than between the upper end of the left prong and the upper end of the right prong;

wherein said clip loop, said left prong, and said right prong are constructed of an elastic solid;

at least one serration on the upper end of the left prong;

at least one serration on the upper end of the right prong;

wherein the permanent gap is adapted to receive a necktie inserted vertically between the lower end of the left prong and the lower end of the right prong;

and wherein the permanent gap is adapted to pinch the tie between the at least one serration on the upper end of the left prong and the at least one serration on the upper end of the right prong.

3. The device of claim 2, wherein:

said hook stem contains a hook screw;

the length of the portion of the hook screw protruding above the hook stem is adjustable;

whereby the hook screw is adapted to make direct contact with the underside of a closet rod;

the hook includes a non-slip grip adapted to make direct contact with the top side of a closet rod.

* * * * *